US006186553B1

(12) United States Patent
Phillips et al.

(10) Patent No.: US 6,186,553 B1
(45) Date of Patent: Feb. 13, 2001

(54) THEME CALENDAR

(76) Inventors: Jacob L. Phillips; Karen Gardner, both of 3420 21st Ave. North, Arlington, VA (US) 22207; Richard L. Phillips; Betty J. Phillips, both of 1291 Lejano La., Santa Fe, NM (US) 87501; John C. Phillips, 3420 21st Ave. North, Arlington, VA (US) 22207

( * ) Notice: Under 35 U.S.C. 154(b), the term of this patent shall be extended for 0 days.

(21) Appl. No.: 09/078,552

(22) Filed: May 14, 1998

(51) Int. Cl.[7] ..... B42D 5/04
(52) U.S. Cl. ..... 283/2; 40/107; 283/67
(58) Field of Search ..... 283/2, 3, 4, 67; 40/107, 335, 110

(56) References Cited

U.S. PATENT DOCUMENTS

| | | | |
|---|---|---|---|
| D. 386,111 | 11/1997 | Kinsey . | |
| 4,720,123 | 1/1988 | Chelius . | |
| 4,858,350 | 8/1989 | Malarchik . | |
| 5,016,017 | 5/1991 | Dubner et al. . | |
| 5,058,296 | 10/1991 | Notzel . | |
| 5,090,733 | 2/1992 | Bussiere . | |
| 5,207,580 | 5/1993 | Strecher . | |
| 5,443,288 | 8/1995 | Miles . | |
| 5,457,904 | 10/1995 | Colvin . | |
| 5,893,586 * | 4/1999 | McGuire | 283/2 |

* cited by examiner

*Primary Examiner*—Willmon Fridie, Jr.
(74) *Attorney, Agent, or Firm*—John C. Phillips

(57) ABSTRACT

A customizable theme calendar includes a set of date cells corresponding to an arbitrarily designated time period (e.g., a starting date and a target date), and a theme applied to the calendar. The theme corresponds to an event associated with the arbitrarily designated time period. The time periods and themes may correspond to recognized holidays such Halloween, Thanksgiving, Easter and so on, or to arbitrarily designated events having personal or familial significance, such as weddings, birthdays, anniversaries, etc. Such customized calendars may be designed and generated in connection with a computer system and calendar generation software.

38 Claims, 8 Drawing Sheets

THEME CALENDAR

BACKGROUND

This invention relates to theme calendars.

An "Advent Calendar" is a familiar type of theme calendar. In general parlance, "advent" refers to a coming or arrival, especially of something awaited or momentous. "Advent" in its proper form is defined as the penitential period beginning four Sundays before Christmas. Advent calendars were originated in the 1920s by a German businessman, Gerhard Lang, as a means for marking the passage of days while counting down to Christmas.

FIG. 1 illustrates a typical implementation of a Christmas Advent calendar 10. A substantially flat (two-dimensional or 2D) member 11 has twenty-five individual cells 13, one for each of the days from December 1st to December 25 (i.e., Christmas Day) along with a Christmas-related motif or theme 12 (e.g., Santa Claus) imprinted thereon. Each of the cells 13 has a closure (e.g., door or flap) 14 which is to be opened when the day corresponding to the cell under consideration arrives. Underneath each flap 14 is a textual message, religious saying or an image that relates to the Christmas theme. Starting on December 1st, an owner of a Christmas Advent calendar 10 opens one flap 14 each day, reads the message for that day, and then continues in this manner, counting down one day at a time until Christmas day arrives.

Various different physical configurations can be used for Christmas advent calendars. For example, as shown in FIG. 2, a three-dimensional (3D) Christmas advent calendar 20 can be constructed in which each date cell has a depth, D, sufficient to hold a 3D object 22 such as a charm, toy, ornament, piece of candy or another token representative of the Christmas theme.

SUMMARY

Various implementations of the invention may include one or more of the following features.

A customizable theme calendar may include a set of date cells corresponding to an arbitrarily designated time period (e.g., a starting date and a target date). The starting date or the target date or both can be selected by an end-user of the calendar. A theme applied to the calendar corresponds to an event associated with the arbitrarily designated time period. The theme and/or event associated with the target date may designated by an end-user of the calendar. The time periods, events and/or themes may correspond to recognized holidays such Halloween, Thanksgiving, Easter and so on, or to arbitrarily designated time periods corresponding to events having personal or familial significance, such as weddings, birthdays, anniversaries, vacations, etc. Alternatively, the time periods, events and/or themes may correspond to physical phenomenon such as celestial events or to other occurrences such as sporting events.

Customization can be achieved by applying a theme or other indicia to the calendar. The theme or other indicia applied to the calendar can include one or more design elements (e.g., shape or physical configuration of the calendar, images or other graphic elements, colors, shapes, textures, sounds, music, text and scents) that are suggestive of the event associated with the arbitrarily designated time period. The customization can include the selection and application of a general theme (e.g., holiday, event, etc.) and/or the "personalization" of the calendar by associating it with a particular person, family, group, team, place, thing, etc.

Producing a customized theme calendar can be accomplished by selecting arbitrary target and/or starting dates, specifying a theme, and generating a calendar bearing indicia suggestive of the specified theme and having a set of date cells that successively count down, or otherwise correspond, to the selected arbitrary target date. The selection of the arbitrary date(s) and/or specifying the theme, can be performed manually by an end-user of the customized theme calendar.

Generating the theme calendar can be performed by a computer system. Optionally, if the end-user performs only one of the date selection and theme specification functions, the computer system can perform the other of the two functions.

As noted, customized calendars may be designed and generated either manually using conventional graphic arts techniques or in connection with a computer system and customizable theme calendar generation software. In either case, the date range for the calendar can be designated automatically based on the theme selected by the end-user of the calendar.

A computer software implemented process of generating a customized theme calendar can be accomplished by customizing a calendar based on at least one of a customer-designated time period and a customer-designated theme. The customization and/or personalization of the calendar can involve the extraction of theme data from a theme database stored in the computer. The calendar can then be customized based on the extracted theme data. An information package descriptive of the customized calendar can be generated and transmitted to a printing facility.

The invention may provide one or more of the following advantages.

The customizable theme calendar as described here not only can provide a mechanism for tracking the arrival of an anticipated event, it adds to the festivity of the occasion and provides a special message or treat each day during the period covered by the calendar. The calendar can be tailored to any desired theme, occasion or event—both recognized holidays such as Halloween and Thanksgiving, and arbitrary dates such as birthdays, anniversaries and other events of personal or familial significance.

These systems and techniques for designing and generating theme calendars provide designers with considerable flexibility. A designer can select any or all of the available design features (date range, images or other graphic elements, colors, content, size, shape, configuration, etc.) or can allow a computer system to make design decisions. As a result, a wide range of customized calendar designs for counting down to, or otherwise celebrating, an awaited event is made available.

Other advantages will become apparent from the following description including the drawings and the claims.

DRAWING DESCRIPTIONS

DETAILED DESCRIPTION

A customizable theme calendar can be tailored to any desired occasion or anticipated event. The calendar can be customized either manually based on user-specified parameters (for example, using conventional graphic design techniques) or automatically using computer-based technology or a combination thereof. The various parameters that can be specified in customizing the calendar include the nature or theme of the anticipated event, the starting and/or target dates corresponding to the countdown period, the size, shape and appearance of the calendar, and the type of message or token behind each closure on the calendar. The theme applied to the calendar generally will be suggestive or symbolic of the underlying event and can include design elements such as images or other graphic elements, colors, shapes, textures, sounds, music, custom text, scents (e.g., scratch & sniff) or other similar indicia.

Figure 1:
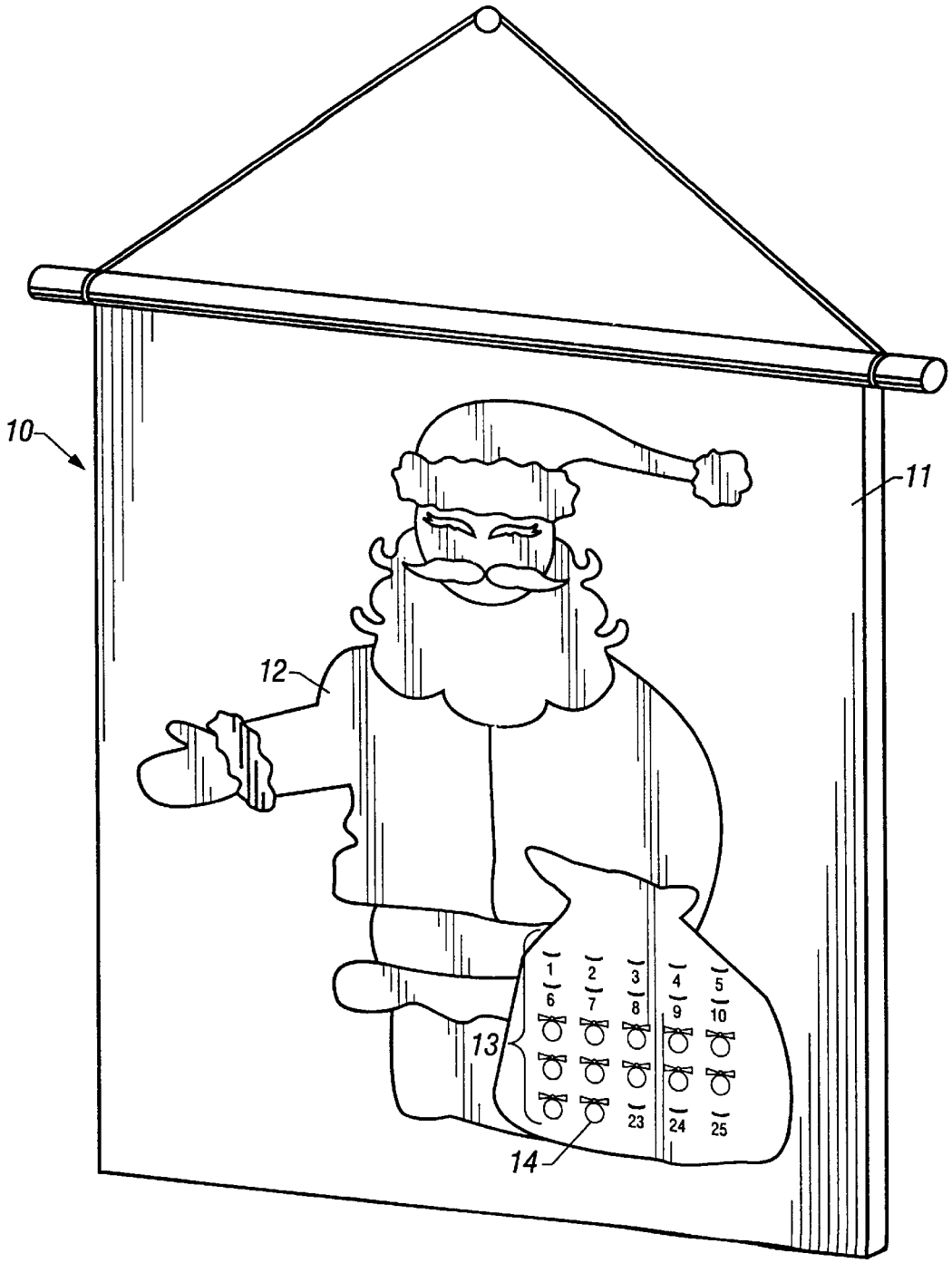
FIG. 1 (PRIOR ART)
FIG. 1 shows an Advent Calendar for counting down to Christmas.
Figure 2:
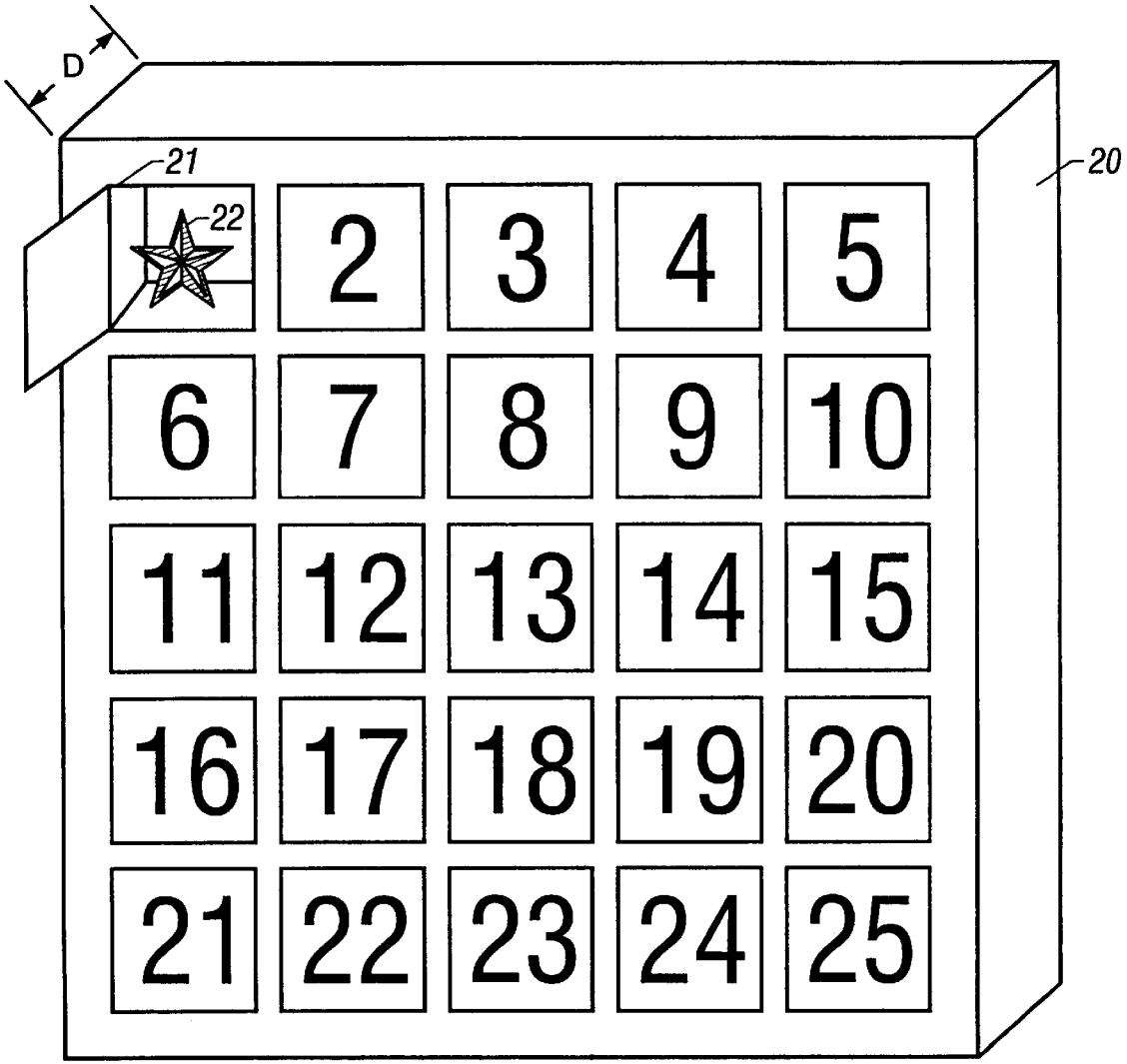
FIG. 2 (PRIOR ART)
FIG. 2 shows an example of a 3D Christmas Advent Calendar.
Figure 3:
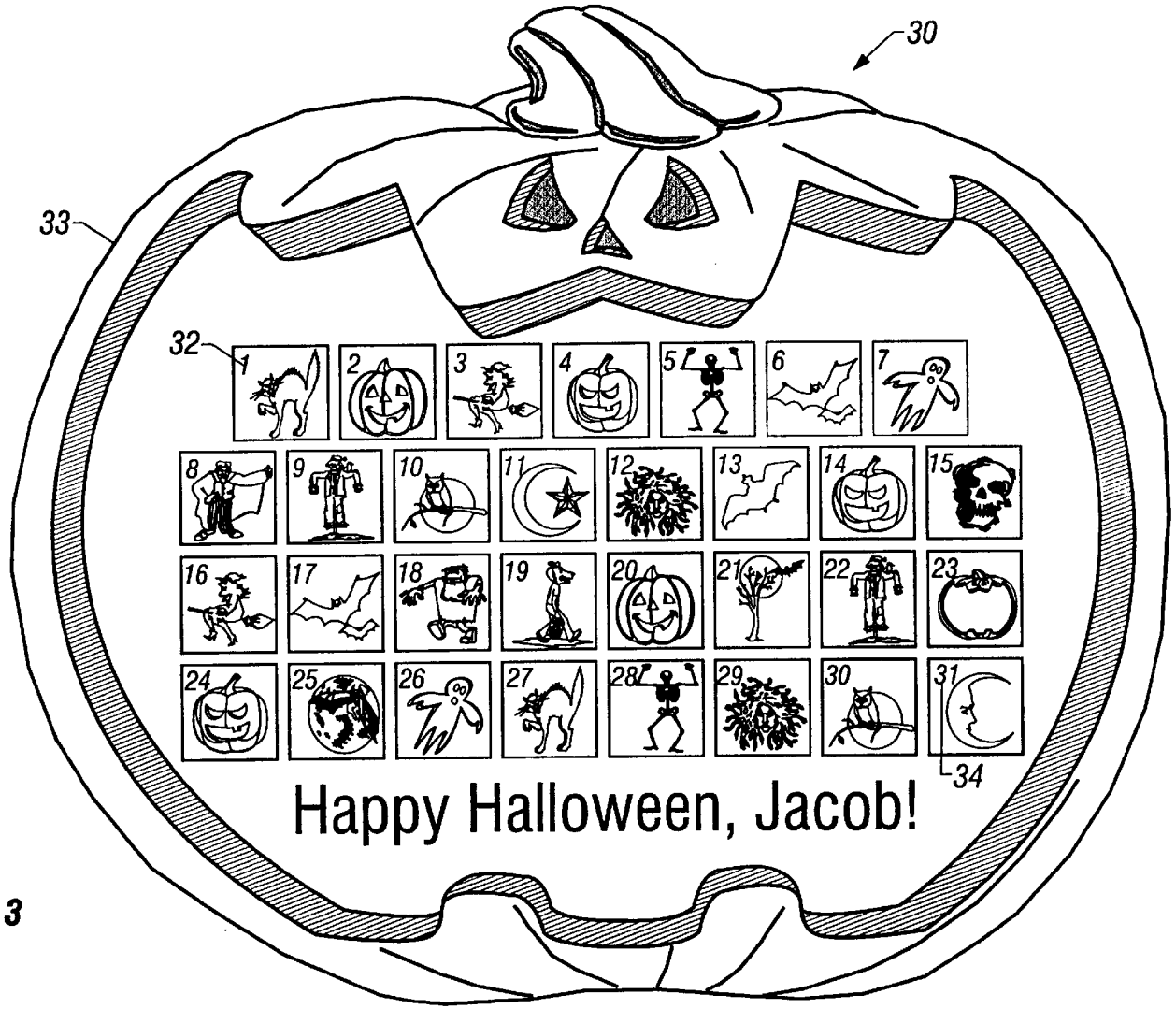
FIG. 3 is an example of a Halloween theme calendar.

FIG. 3 shows an example of a customized theme calendar 30 in which the anticipated event is Halloween, which falls on October 31st each year. As shown in FIG. 3, the starting date 32 and target date 34 in this example are October 1st and October 31st, respectively, making the countdown period equal to the entire 31 days in the month of October. Alternatively, a shorter countdown period could be used instead by designating a starting date closer (e.g., October 10th) to the date of the anticipated event.

In customizing the calendar 30 for Halloween, various different parameters can be designated by the designer of the calendar or can be selected automatically by a computer system, or both. For example, as described below in more detail, a computer system could include several standard variations of a Halloween theme calendar. The designer of the calendar either could select one of the standard variations to serve as the final calendar or could design a Halloween theme calendar from scratch, using individual component options (e.g., clip art, design choices, shapes, materials, texture maps, messages, etc.) made available by the computer system. Similarly, the designer could use one of the available standard variations as a starting point and then modify it according to the desired preferences. The designer of the calendar could be virtually anyone, for example, the end-purchaser and/or user of the calendar, a small business owner that sells cards, stationery, calendars and the like, or a design professional working for a calendar-making company.

Instead of the artwork shown on the Halloween calendar in FIG. 3 (e.g., jack-o-lantern background with images of witches, black cats, pumpkins, bats, etc. on the date cell flaps), the designer could select additional or alternative images such as ghosts, ghouls, etc., and further could designate the placement and orientation of the selected images on the calendar. In addition, the designer could choose a different shape or background for the calendar (e.g., a haunted house), a different countdown period, a different configuration (2D or 3D), and different types of objects (e.g., candy or toys) or messages (e.g., Halloween-related jokes or poems) that appear behind each door on the calendar.

Virtually any holiday or occasion can serve as the theme for a customizable calendar. For example, instead of Halloween, a calendar could be customized as desired in commemoration of Channukah, Kwanza, Thanksgiving, Valentine's Day, St. Patrick's Day, Easter, Independence Day, New Year's Day, Martin Luther King, Jr. Day, Mothers Day, Memorial Day, and so on.

Figure 4:
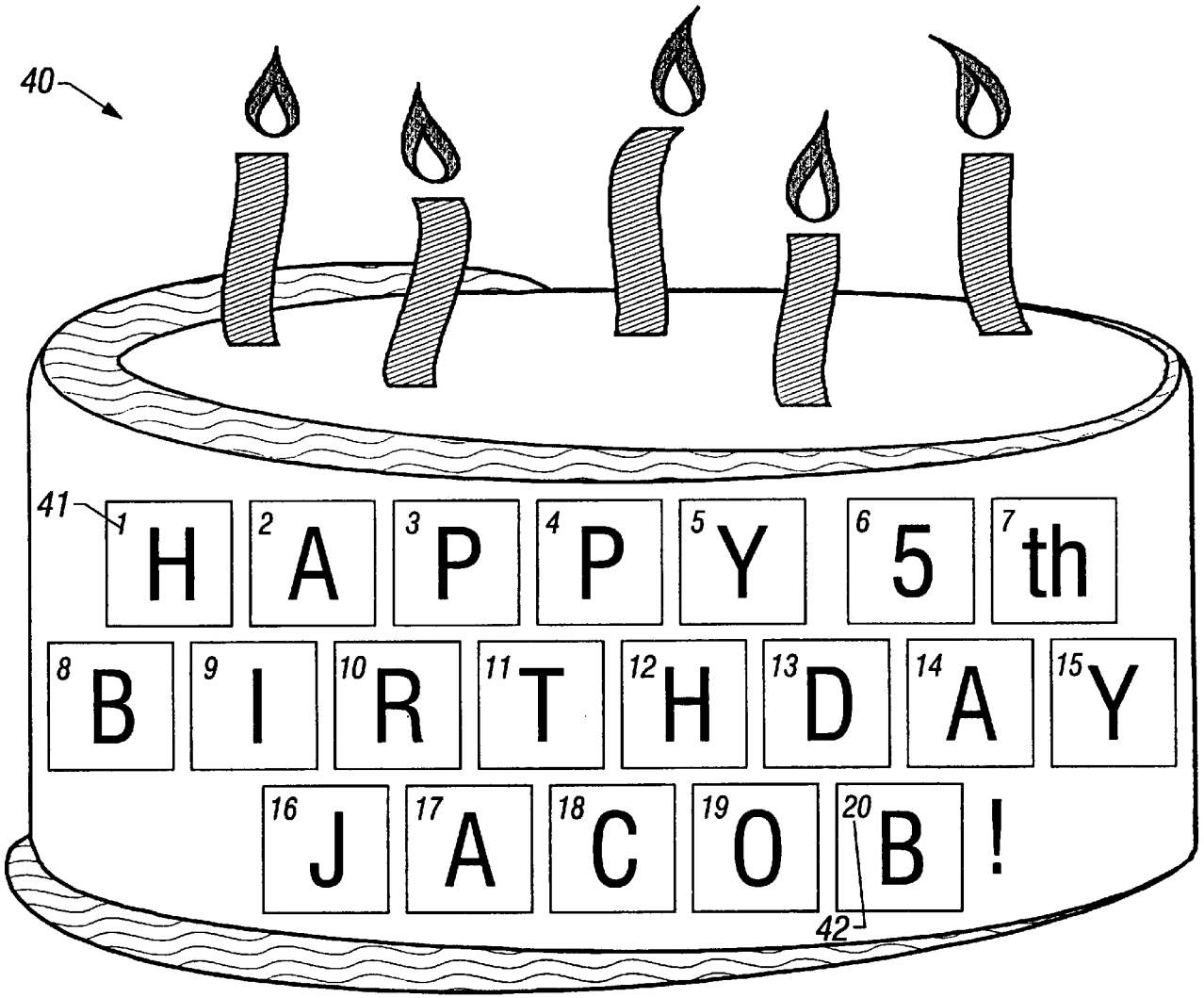
FIG. 4 is an example of a birthday theme calendar.
Figure 5:
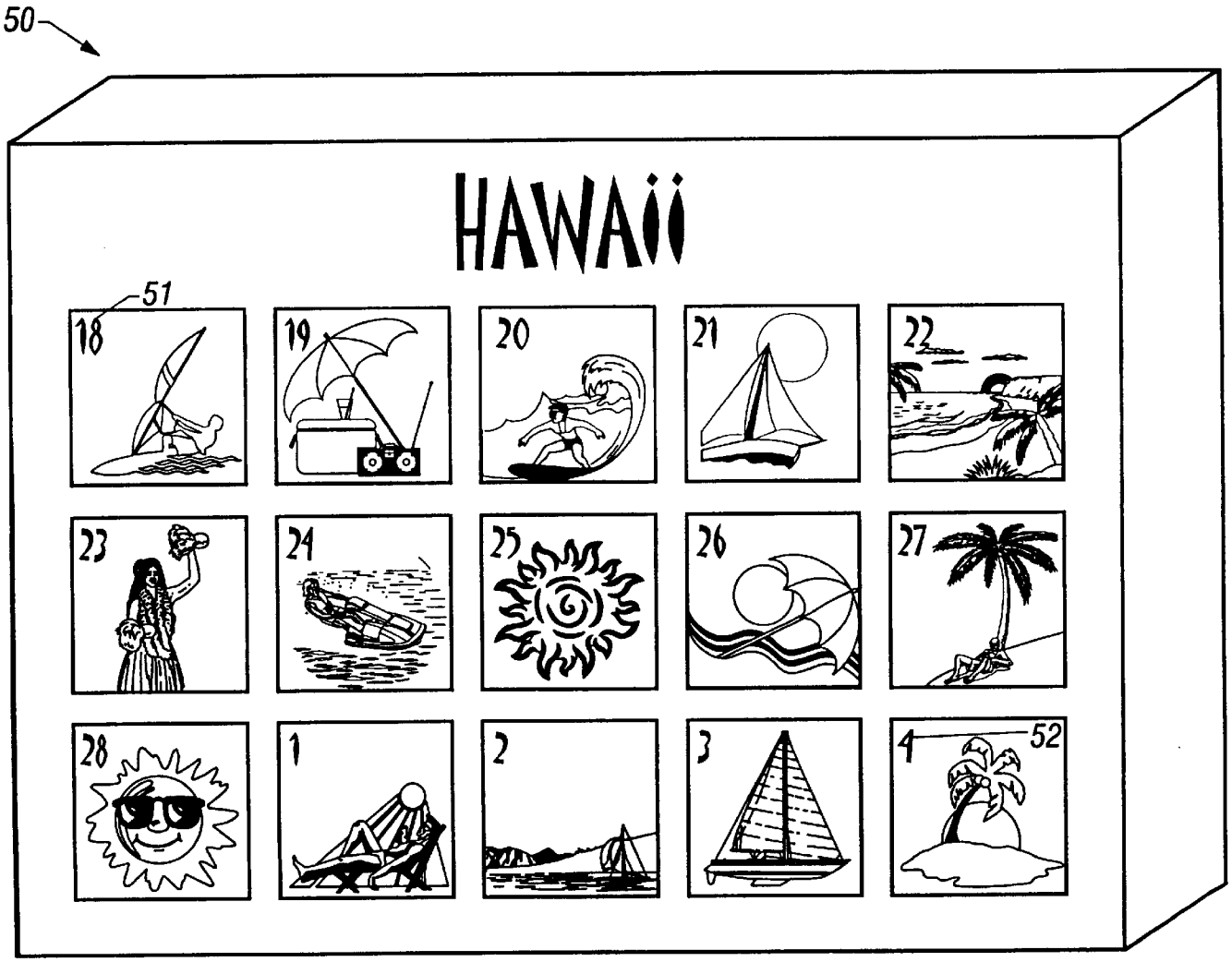
FIG. 5 is an example of a vacation theme calendar.

The theme of the customizable calendar need not correspond to a recognized holiday or occasion, however. Rather, as shown in FIGS. 4 and 5, theme calendars also can be customized for any arbitrary theme, event, occasion and/or countdown period as desired. Events that have personal or familial significance (e.g., birthdays, weddings, anniversaries, etc.) likely would be popular candidates for customized calendars. Such calendars also could be "personalized" by creating an association with a particular name, person, family, group, team, place, thing, etc. As discussed below in more detail with respect to FIG. 8, such personalization can be achieved, among other ways, by applying custom input from various sources (e.g., scanner, digital still camera, video frame, custom text) to the calendar.

In FIG. 4, for example, the calendar 40 has been customized for a boy's birthday falling on the 20th of August. In this example, the calendar has been customized in at least two distinct senses. First, a custom general theme (i.e., birthday) has been designated and, second, a personalized association (textual message memorializing Jacob's 5th birthday) has been applied to the calendar. In general, a theme calendar may be customized, among other ways, by employing either or both of these two types of customization (i.e., general theme and personalization) to arrive at the desired design.

The theme calendar of FIG. 4 includes several elements, features, and design components that add to its customization. These include the starting date 41 and target date 42 (which in this example were chosen to be the 1st and the 20th of the month), the designated shape and configuration (a 2D flat calendar in the shape of a birthday cake), and the selected artwork including candles, icing and a theme-related, personalized message: "Happy 5th Birthday Jacob!".

FIG. 5 illustrates another example of a customized theme calendar 50 tailored to an arbitrarily selected theme, event and/or countdown period. The arbitrary event is the start of a family trip to a destination such as a theme park or other vacation spot, such as Disney World or, in the example shown, Hawaii. The selected theme (polynesian and south seas motif) corresponds to the underlying event to further emphasize and celebrate the festivity associated with the occasion.

In the calendar shown in FIG. 5, the target date 52 (March 4th) associated with the event (departure for Hawaii) is relatively early in the calendar month. Accordingly, rather than constraining the countdown period to occur within the boundaries of a single month, the starting date 51 can be designated to occur in a previous month to allow a longer countdown period. In this case, the starting date 51 was selected as February 18th to create a countdown period of 15 days. As a result, the life span of the calendar, and consequently its anticipatory effect, are increased to the desired level.

Customized theme calendars can be tailored to virtually any anticipated event or occasion. For example, by selecting appropriate parameters such as themes, starting and target dates, configurations and the like, a calendar could be customized to celebrate an upcoming wedding, birthday, anniversary, religious event (e.g., bar or bat mitzvah or confirmation), celebration (e.g., Mardi Gras), sporting event (e.g. Super Sunday, Olympics, World Cup Soccer, etc.), last day of school, graduation, spring or summer vacation, cruise, trip, new job, and so on. A theme calendar also could be customized to track upcoming celestial events (e.g., solar eclipse) or other physical phenomena.

Figure 6:
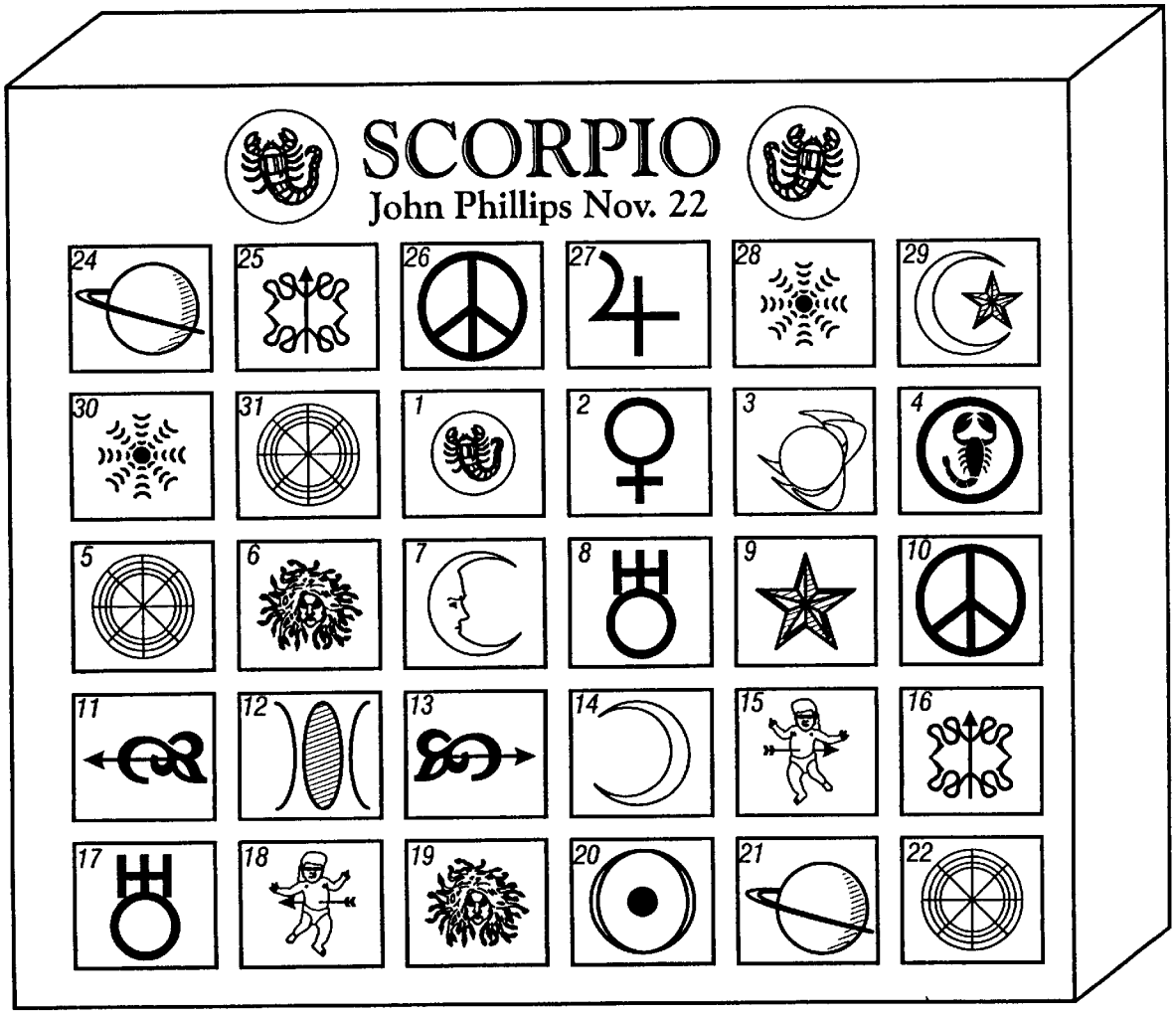
FIG. 6 is an example of an astrological theme calendar.

Customizable theme calendars also could be tailored to astrology. As shown in FIG. 6, a different customized calendar could be designed for each astrological sign (e.g., Scorpio) and could be further tailored to take into account the end-user's specific preferences and personal information (e.g., name, birth date, gender, age, etc.). A daily horoscope tailored to the specific individual for whom the calendar was designed could appear behind each date cell flap. As shown in FIG. 6, the astrological theme calendar is customized to use the end-user's particular birthday ("John Phillips Nov. 22"), which also happens to coincide with the last day of the Scorpio sign, as the target date for the calendar.

A theme calendar also could be customized to count down to, or otherwise track and celebrate, multiple events or milestones associated with a common occasion. For example, a customized theme calendar could be customized as a wedding planning calendar to track the various dates and milestones (e.g., ring purchase, engagement, bridal shower, bachelor's party, wedding dress purchase, rehearsal dinner, wedding ceremony, honeymoon) associated with a wedding. In this example, the customized calendar would have multiple target dates (i.e., one for each milestone) as well as multiple sub-themes relating to the various milestones, all of which collectively contribute to the common unifying theme.

The design and other customization of a theme calendar could be accomplished either through the manual efforts of a designer or with the aid of a computer system and design software, or through a combination thereof. For example, a designer could use a calendar creation software program having a graphical user interface (GUI) to present the designer with various design options.

Figure 7:
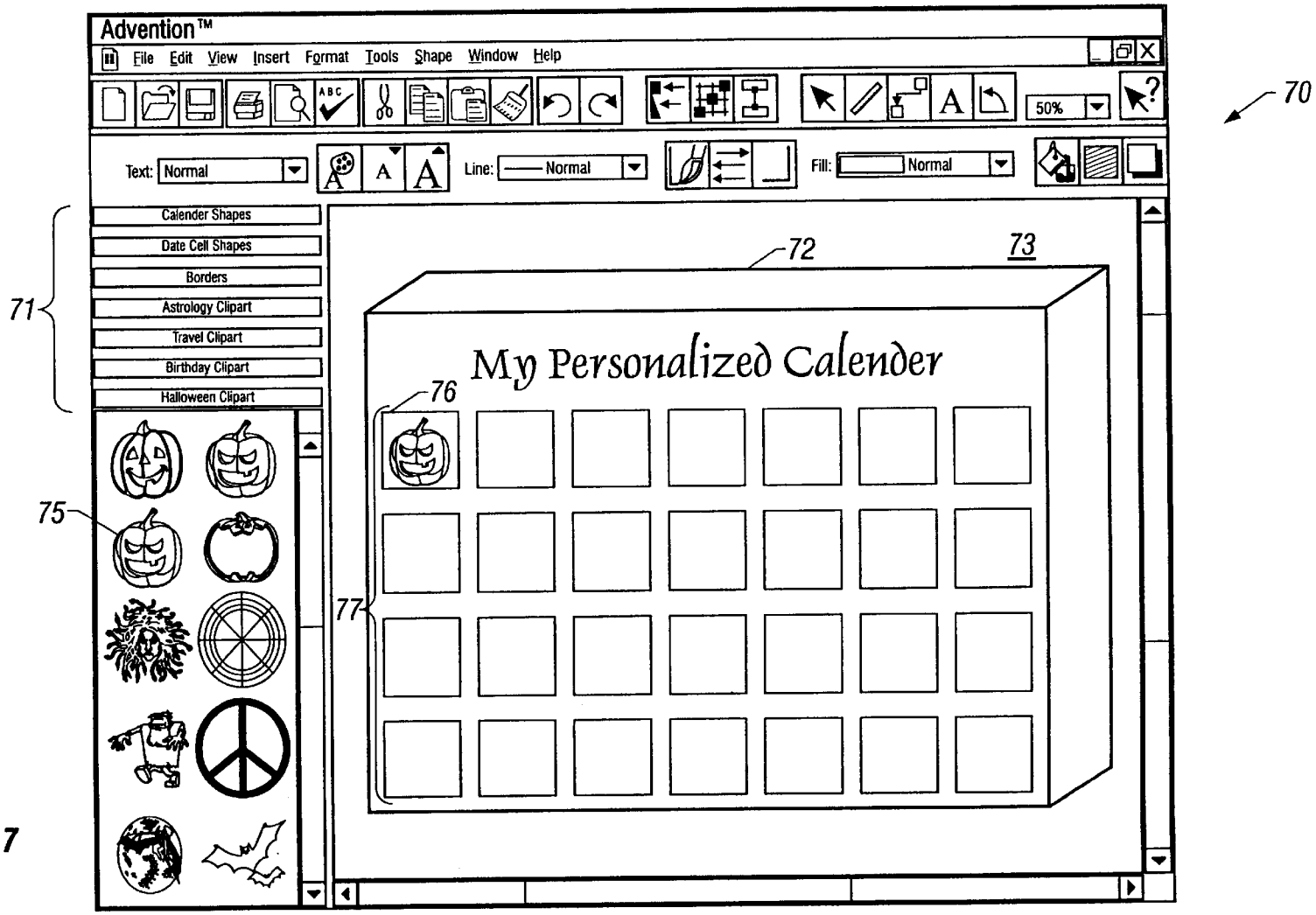
FIG. 7 is an example of a graphical user interface that can be used with software for creating customized theme calendars.

FIG. 7 illustrates an example of a GUI 70 that could be used with software for creating customized theme calendars (for example, software sold under the brandname ADVENTION™). As shown, the GUI 70 presents the designer with the available design choices in the form of palettes 71 and other graphical abstractions representing available design options. The designer can make selective use of the design components made available by the graphical abstractions to construct a customized theme calendar in the editing region 73. The options made available by the palettes 71 and other graphical abstractions could include items such as themes, artwork styles (impressionistic, abstract, etc.), clip art items, calendar formats (calendar shape, cell shape and layout), content choices (e.g., sayings, images, web addresses, jokes, etc.) and the like.

By navigating the GUI and selecting the desired features, a designer could choose design components and parameters to achieve the desired customized theme calendar. In the example shown in FIG. 7, the designer has selected a rectangular, 3D calendar 72 having twenty-eight rectangular date cells 77 arranged in a 7×4 matrix of elements. The designer has begun to further customize the calendar 72 by adding custom text 74 and by dragging an instance 75 of an image from the Halloween Clipart palette 71 to date cell 76. The designer typically would continue customizing the calendar 72 in this manner until the desired final design was achieved.

Virtually all design parameters could be chosen from the GUI by the designer manually, or the computer could chose some or all of the design parameters automatically based on basic information entered by the designer. Put another way, many of the design parameters could be optional input from the standpoint of the designer. The other design parameters needed to complete the design could be chosen by the calendar creation software based, for example, on the selected theme and countdown dates specified by the designer. In this manner, the calendar creation software could design a customized calendar automatically, or semi-automatically, by selecting various corresponding design features from a database of design information. This database could contain not only calendar information, but also information on various holidays and their corresponding themes, countdown periods, colors, associated content, configurations, and so on. For example, if the designer designated Thanksgiving (a moving holiday) as the target date, the calendar creation software could auto-generate the appropriate date range based on the current calendar year and could auto-select theme-appropriate artwork (e.g., turkeys, pilgrims) and theme-appropriate 2D content (poems, sayings, religious messages, etc.), all without any further input from the designer.

Figure 8:
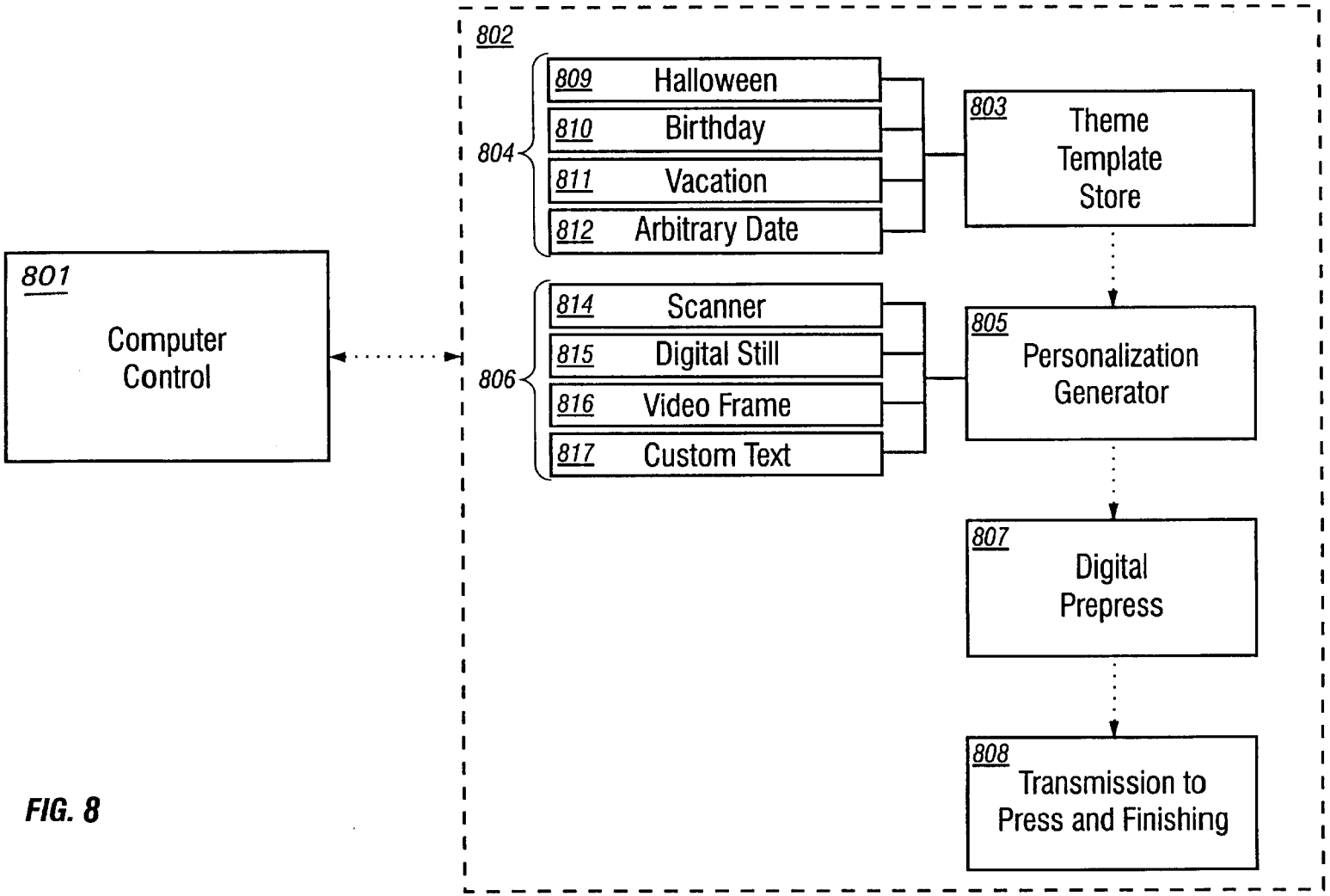
FIG. 8 is a diagram of a software architecture that can be used to generate customizable theme calendars.

The software architecture block diagram in FIG. 8 illustrates functions that a calendar creation program 802 could employ. The computer system, 801, invokes each of the functions in the appropriate order. The theme template store 803 generally will be the first software component invoked. Its function is to access data representing the appropriate theme element from the theme database 804 and to designate it as the current context for all subsequent operations. Only a few of the possible theme datasets are represented in theme database 804. Others already have been discussed above. Assume, for purposes of describing an example, that the birthday theme 810 as shown in FIG. 4 has been selected. The theme selected in this step corresponds to the general thematic customization of the calendar independent of any personalization.

Next, the personalization generator 805 is invoked. Personalized customization can be derived from many sources; a few possibilities are represented in the ensemble of input sources 806 (scanner 814, digital still 815, video frame 816, custom text 818) shown in FIG. 8. Any or all of the personalized customization input sources 806 could be used as desired in designing a customized theme calendar. For example, a photograph or other graphic image can be scanned with scanner 814 to produce a digital calendar element. Alternatively, or in addition, an image from a digital still camera 815 and/or a frame from an analog or digital video sequence 816 could be used as a calendar design element. Textual information 817 can be used to specify a name, message, saying or other relevant custom information. The personalization effected in this step corresponds to the personalized association applied to the calendar. Although the software architecture in FIG. 8 employs both general thematic customization and personalized customization, either of these two types of customization could be used alone, independently of the other.

Yet another possibility for general and/or personalized customization would be to include voice or music that is to be associated with one or more dates of the calendar. Such sound can be activated by raising a flap over the appropriate date. Greeting cards have long been available with such devices.

The next function invoked is digital prepress 807. This function prepares a digital package that includes the description of the calendar for subsequent printing on a digital printing press. Among the tasks the digital prepress function 807 typically performs is conversion of all colors in the calendar to the CMYK (cyan, magenta, yellow, black) coordinate system, conversion of all images to an acceptable format (e.g., TIFF or EPS), and incorporation of all font definitions used in the calendar. The exact tasks performed by the digital prepress function 807 are determined, among other factors, by the characteristics of the intended digital press and the requirements imposed by the printing facility (e.g., service bureau) that will print the final product.

Final production typically will be done on digital offset printing presses. Digital offset, a current technology in the color printing industry, offers the quality of traditional offset printing, but capitalizes on the efficiency of a completely digital workflow. The prepress package described above goes directly to press, bypassing the traditional steps of film separations, film stripping and plate burning. Typical digital offset printing presses that are now readily available through service bureaus include the Indigo E-Print 1000 and the Heidelberg Quickmaster DI.

Finally, the prepress package, the output of the digital prepress stage 807, can be transmitted to a local digital printer or to a service bureau by the transmission function 808. Many such service bureaus are available; a typical one is IMAGERS Digital Production Center, 1575 Northside Drive N.W., Atlanta, Ga. 30318. The prepress package typically is sent directly to the printing facility or service bureau over a direct local area network (LAN) connection or an Internet network connection. Alternatively, the prepress package could be sent to the printing facility on a removable medium such as CD-ROM, floppy disk, magnetic tape, etc. After printing the product, other processing such as die cutting, packaging and mailing could be performed, potentially all by the same service bureau that handled the printing.

The customized calendar generating system described here is highly scalable to accommodate varying degrees of functionality, sophistication and complexity. On the one end of the spectrum, a large commercial organization, such as a stationery or greeting card company, could employ such a system in producing high-end customized calendars. A somewhat lower-end customized calendar could be designed, generated and sold by a small business owner, for example, operating out of a booth in a shopping mall. In that case, the customized calendars would benefit from a quick turn-around time between the inception of the design and ultimate delivery to the customer, but likely this benefit would come at the expense of sophistication and/or quality of the product sold.

On the other end of the spectrum, a relatively unsophisticated computer user could employ a standard personal computer (PC) system and suitable peripherals as a design and manufacturing platform. In this case, the user likely could generate customized calendars at will (for example, for personal use or to serve as gifts for friends and family) after purchasing the appropriate software, peripherals (e.g., specialized printers or printing attachments) and supplies (e.g., card stock in calendar shapes with pre-formed date cells and perforated flaps).

Another alternative platform for customized calendar design and generation is an in-store special purpose computer and production system, similar to the customized greeting card machines found in some card shops.

The calendar generation software described here could possess intelligent and flexible calendaring capabilities. For example, the software could auto-select date ranges and would have knowledge of the Gregorian and Julian (or other) calendars for all relevant years (e.g., 1998–2100) so that potential complications such as leap years and moving holidays (e.g., Easter or Thanksgiving) could be handled seamlessly and automatically. The selected date range allowed by the calendar creation software could be virtually any size (e.g., 2–100 days) and could span month or year boundaries as desired.

The techniques, mechanisms and systems described here may find applicability in any computing or processing environment in which graphical content may be created or manipulated. They may be implemented in hardware or software, or a combination of the two. Preferably, the techniques are implemented in computer programs executing on programmable computers that each include a processor, a storage medium readable by the processor (including volatile and non-volatile memory and/or storage elements), and suitable input and output devices. Program code is applied to data entered using the input device to perform the functions described and to generate output information. The output information is applied to one or more output devices.

Each program is preferably implemented in a high level procedural or object oriented programming language to communicate with a computer system. However, the programs can be implemented in assembly language, if desired. In any case, the language may be a compiled or interpreted language.

Each such computer program is preferably stored on a storage medium or device (e.g., CD-ROM, hard disk or magnetic diskette) that is readable by a general or special purpose programmable computer for configuring and operating the computer when the storage medium or device is read by the computer to perform procedures such as those described in this document. The system also may be considered to be implemented as a computer-readable storage medium, configured with a computer program, where the storage medium so configured causes a computer to operate in a specific and predefined manner.

Other embodiments are within the scope of the following claims.

What is claimed is:

1. A method of producing a customized advent-type calendar, the method comprising:

receiving input designating a customized time period including at least one of a starting date representing a specific Gregorian date and an ending date representing another specific Gregorian date;

receiving input specifying a graphical theme that is complementary to the designated customized time period; and generating a customized advent-type calendar bearing indicia suggestive of the specified graphical theme and having a plurality of date cells corresponding to the customized time period, each date cell having, an associated Gregorian date indicated thereon and comprising a closure element for concealing an object or information, or both.

2. An advent-type calendar comprising:

a plurality of date cells corresponding to a customized time period including a starting date representing a specific Gregorian date and an ending date representing another specific Gregorian date, each date cell having an associated Gregorian date indicated thereon and comprising a closure element for concealing an object or information, or both; and a graphical theme applied to the advent-type calendar, the graphical theme being suggestive of an event associated with the customized time period.

3. The calendar of claim 2 in which the customized time period corresponds to an event having personal or familial significance.

4. The calendar of claim 3 in which the event having personal or familial significance is a birthday, an anniversary, a vacation, an upcoming trip, a wedding, a religious occasion, or a graduation.

5. The calendar of claim 2 in which the customized time period corresponds to a sporting event, a physical phenomenon, or a media event.

6. The calendar of claim 2 in which the starting date or the ending date corresponds to a movie premiere or a book release.

7. The calendar of claim 2 in which at least one of the customized time period and the graphical theme corresponds to a recognized holiday.

8. The calendar of claim 7 in which the recognized holiday is Halloween, Valentine's Day, Thanksgiving, New Year's Day, Easter, Independence Day, Channukah, Kwanza, St. Patrick's Day, Martin Luther King, Jr. Day, Mothers Day, Fathers Day, Memorial Day or Labor Day.

9. The calendar of claim 2 in which the graphical theme applied to the calendar comprises one or more design elements that are suggestive of the event associated with the customized time period.

10. The calendar of claim 2 in which the graphical theme applied to the calendar comprises a shape or physical configuration of the calendar that is suggestive of the event associated with the customized time period.

11. The calendar of claim 2 in which the graphical theme applied to the calendar comprises one or more of the following design elements: images, graphic elements, colors, shapes, textures, sounds, music, text and scents.

12. The calendar of claim 2 in which the graphical theme applied to the calendar comprises a customized general theme.

13. The calendar of claim 2 in which the graphical theme applied to the calendar comprises a personalized association.

14. The calendar of claim 13 in which the personalized association is derived from input received from one or more of the following input sources: a scanner, a digital camera, a video input device, or a custom text generator.

15. The calendar of claim 2 in which the graphical theme applied to the calendar comprises a customized general theme and a personalized association.

16. The calendar of claim 2 further comprising a plurality of milestones associated with the customized time period.

17. The calendar of claim 16 in which each of the plurality of milestones represents progress towards the event associated with the customized time period.

18. The calendar of claim 16 in which the plurality of milestones correspond to events associated with a wedding.

19. The method of claim 1 in which if the input received designating a customized time period includes only one of a starting date and an ending date, then a computer system specifics the other of the starting date and the ending date.

20. The method of claim 1 in which at least a portion of the received input is supplied by a human operator.

21. The method of claim 20 in which the human operator is an end-user of the calendar.

22. The method of claim 20 in which the human operator is someone other than an end-user of the calendar.

23. The method of claim 1 in which at least a portion of the received input is supplied by a computer system.

24. The method of claim 1 in which the indicia suggestive of the specified graphical theme comprise a general theme, a personalized association, or both.

25. The method of claim 1 in which a human operator supplies the input designating a customized time period and, based on the human operator-supplied input, a computer system supplies at least a portion of the input specifying the graphical theme.

26. The method of claim 1 in which the customized time period corresponds to a recognized holiday.

27. The method of claim 1 in which the customized time period corresponds to an event having personal or familial significance.

28. The method of claim 1 in which the input designating the customized time period further comprises a plurality of milestones associated with the customized time period.

29. The method of claim 28 in which each of the plurality of milestones represents progress towards an event associated with the customized time period.

30. The method of claim 1 in which generating the calendar is performed by a computer-controlled manufacturing system.

31. The method of claim 1 in which generating the calendar is controlled by a computer system.

32. The method of claim 31 in which generating the calendar comprises:

extracting theme data from a theme database; and customizing the calendar based on the extracted theme data.

33. The method of claim 32 further comprising:

generating an information package descriptive of the customized calendar; and transmitting the generated information package to a printing facility.

34. The method of claim 1 in which receiving input designating the customized time period and receiving input specifying the graphical theme occur at substantially a same time.

35. The method of claim 1 in which the input designating the customized time period and the input specifying the graphical theme are included in a single input instance.

36. The method of claim 1 in which receiving input designating the customized time period and receiving input specifying the graphical theme are order independent.

37. A method of producing a customized advent-type calendar, the method comprising:

receiving input specifying a customized time period including at least one of a starting date representing a specific Gregorian date and an ending date representing another specific Gregorian date;

selecting from a computer database a graphical theme that is complementary to the designated customized time period; and generating a customized advent-type calendar bearing indicia suggestive of the selected graphical theme and having a plurality of date cells corresponding to the customized time period, each date cell having an associated Gregorian date indicated thereon and comprising a closure element for concealing an object or information, or both.

38. An advent-type calendar comprising:

a plurality of date cells corresponding to a customized time period including a starting date representing a specific Gregorian date and an ending date representing another specific Gregorian date, each date cell having an associated Gregorian date indicated thereon and comprising a closure element for concealing an object or information, or both, wherein the plurality date cells includes one or more milestones associated with the customized time period, each milestone representing progress towards an event associated with the customized time period; and a graphical theme applied to the advent-type calendar, the graphical theme being suggestive of an event associated with the customized time period.

* * * * *